US007534997B2

(12) United States Patent
Li

(10) Patent No.: US 7,534,997 B2
(45) Date of Patent: May 19, 2009

(54) MASS SPECTROMETER INTERFACE FOR ATMOSPHERIC IONIZATION ION SOURCES

(75) Inventor: Gangqiang Li, Palo Alto, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 421 days.

(21) Appl. No.: 11/441,542

(22) Filed: May 25, 2006

(65) Prior Publication Data

US 2008/0067355 A1 Mar. 20, 2008

(51) Int. Cl.
*H01J 49/04* (2006.01)

(52) U.S. Cl. ..... 250/288; 250/281; 250/292; 250/294; 250/423 F; 250/423 R

(58) Field of Classification Search ..... 250/288, 250/281, 291, 292, 294, 284, 423 R, 423 F
See application file for complete search history.

(56) References Cited

U.S. PATENT DOCUMENTS

| | | | | |
|---|---|---|---|---|
| 4,023,398 | A | 5/1977 | French et al. | |
| 4,999,493 | A | 3/1991 | Allen et al. | |
| 5,495,108 | A | 2/1996 | Apffel, Jr. et al. | |
| 5,750,988 | A | 5/1998 | Apffel et al. | |
| 5,936,242 | A * | 8/1999 | De La Mora et al. | 250/288 |
| RE36,892 | E | 10/2000 | Apffel, Jr. et al. | |
| 6,278,110 | B1 | 8/2001 | Apffel et al. | |
| 6,278,111 | B1 | 8/2001 | Sheehan et al. | |
| 6,294,779 | B1 | 9/2001 | Apffel et al. | |
| 6,462,338 | B1 * | 10/2002 | Inatsugu et al. | 250/292 |
| 6,498,343 | B2 | 12/2002 | Apffel et al. | |
| 6,639,216 | B2 | 10/2003 | Apffel, Jr. et al. | |
| 6,700,119 | B1 * | 3/2004 | Giles | 250/288 |
| 6,797,946 | B2 | 9/2004 | Apffel, Jr. et al. | |
| 2002/0121598 | A1 * | 9/2002 | Park | 250/288 |
| 2003/0062474 | A1 * | 4/2003 | Baranov et al. | 250/288 |
| 2004/0046126 | A1 * | 3/2004 | Fisher et al. | 250/423 P |
| 2005/0161598 | A1 * | 7/2005 | Guevremont et al. | 250/294 |
| 2005/0230617 | A1 * | 10/2005 | Montaser et al. | 250/288 |
| 2005/0258363 | A1 * | 11/2005 | Syms | 250/292 |
| 2005/0269518 | A1 * | 12/2005 | Bajic et al. | 250/423 F |
| 2006/0016982 | A1 * | 1/2006 | Russ et al. | 250/288 |
| 2006/0151694 | A1 * | 7/2006 | Guevremont et al. | 250/292 |
| 2007/0181800 | A1 * | 8/2007 | Jolliffe et al. | 250/288 |

OTHER PUBLICATIONS

GB Search Report under Section 17 dated Dec. 17, 2007.

* cited by examiner

*Primary Examiner*—David A. Vanore
*Assistant Examiner*—Michael J Logie
(74) *Attorney, Agent, or Firm*—James C. Pintner

(57) ABSTRACT

A mass spectrometer sample input interface comprises a desolvation apparatus defining a desolvation pathway along which a desolvation gas flows, in a direction from upstream to downstream, the desolvation pathway having a desolvation pathway portion; and an ion pathway apparatus for defining an ion pathway for analyte solution droplets to follow, the ion pathway leading into the mass spectrometer, the ion pathway including an ion pathway portion that follows the desolvation pathway portion.

14 Claims, 4 Drawing Sheets

MASS SPECTROMETER INTERFACE FOR ATMOSPHERIC IONIZATION ION SOURCES

BACKGROUND OF THE INVENTION

Atmospheric pressure ionization (API) methods have been widely used in mass spectrometry applications because they can be utilized for a wide range of chemical and biological samples. Ionization of a gaseous analyte sample at atmospheric pressure has advantages such as simplicity and accessibility during the operation. Thus, mass spectrometer systems are designed such that a sample, ionized at atmospheric pressure, is transmitted through a mass spectrometer sample input interface (hereinafter "mass spectrometer interface" or "interface") into the mass spectrometer for analysis.

Mass spectrometers typically operate at pressures much lower than atmospheric pressure, typically $10^{-4}$ to $10^{-9}$ torr. Such pressures are generally regarded, and referred to, as vacuum pressure. Thus, one design objective of a mass spectrometer interface is to accommodate this orders-of-magnitude difference in pressure. The interface facilitates the evacuation of the ionized gaseous sample down to the mass spectrometer's operating pressure as it directs the sample into the mass spectrometer. As a consequence, a large portion of the ions generated at atmospheric pressure in the sample are lost during the process of evacuation and transmission. This loss potentially can be a drawback, in that it tends to reduce the sensitivity of the mass spectrometer.

In many mass spectrometer systems, analyte sample solutions are atomized or sprayed into a mist of fine droplets, and then ionized, to impart electrical charge on the droplets. These charged droplets undergo a desolvation process, and become single or multiple charged gaseous ions. However, some of the droplets survive the desolvation and enter the mass spectrometer's vacuum chamber. Incompletely desolvated droplets of analyte solution in a mass spectrometer can reach the mass spectrometer's detector, and cause undesirable noise signals, thereby reducing the sensitivity of the mass spectrometer.

Therefore, to maximize sensitivity of the analysis by the mass spectrometer, the interface should be designed (i) to minimize sample loss or otherwise operate effectively despite the sample loss, and (ii) to maximize desolvation and otherwise minimize or eliminate noise.

SUMMARY OF THE INVENTION

A mass spectrometer sample input interface comprises a desolvation apparatus defining a desolvation pathway along which a desolvation gas flows, in a direction from upstream to downstream, the desolvation pathway having a desolvation pathway portion; and an ion pathway apparatus for defining an ion pathway for analyte solution droplets to follow, the ion pathway leading into the mass spectrometer, the ion pathway including an ion pathway portion that follows the desolvation pathway portion.

Further features and advantages of the present invention, as well as the structure and operation of preferred embodiments of the present invention, are described in detail below with reference to the accompanying exemplary drawings.

DETAILED DESCRIPTION

An example of a mass spectrometer interface is an electrospray ionization (ESI) system. In such a system, a source uses a capillary to deliver a sample solution from a sample pump, or from a liquid or gas chromatographic effluent, to an ionizer, such as a metal or metalized needle, at a location near the mass spectrometer interface. By applying an electric field between the needle and the interface, charged droplets are generated as a continuous spray.

Figure 1:
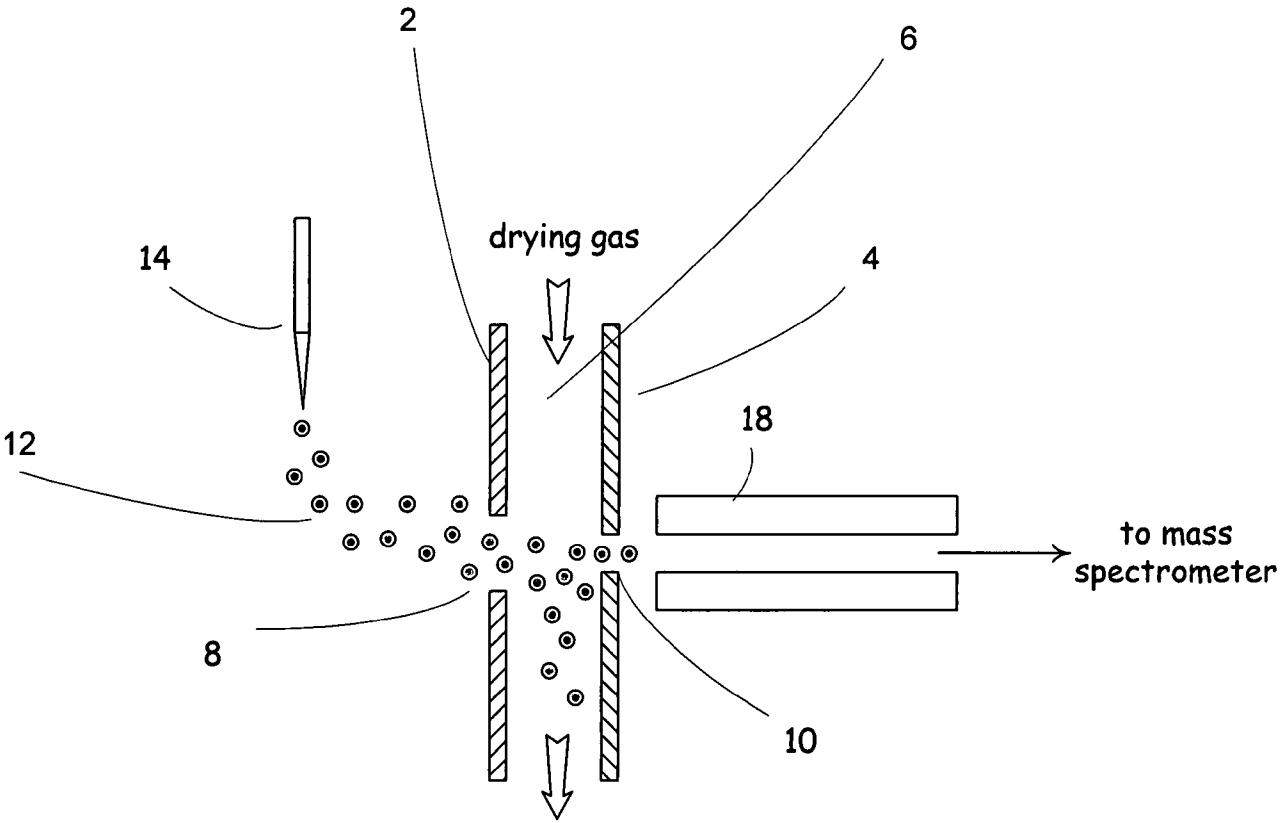
FIG. 1 prior art
FIG. 1 is a diagram of a prior art mass spectrometer sample input interface.

In a prior art embodiment (FIG. 1), an interface is constructed using two conductive plates 2 and 4, arranged parallel to each other, and with an orifice (8 and 10, respectively) in each plate. The two orifices 8 and 10 are coaxially aligned, and the first orifice (which faces the atmosphere) is usually larger than the second orifice (at the vacuum side).

While charged droplets 12 enter the first orifice 8, a heated drying gas stream (usually nitrogen gas) is sent across the space between two plates 2 and 4. By colliding with drying gas molecules, the charged droplets 12 undergo a desolvation process and become single or multiple charged ions. These ions continue to propagate into vacuum via the second orifice 10, and are analyzed by a mass spectrometer (not shown).

During the time crossing between the first and second orifices 8 and 10, many of the droplets 12 are carried away by drying gas, and become waste. Some of the droplets 12 survive the desolvation and enter the vacuum chamber of the mass spectrometer. This portion of incompletely desolvated droplets 12 contributes largely to the signal noise and sacrifices instrument sensitivity.

Embodiments of the invention include a mass spectrometer sample input interface comprising a desolvation apparatus and an ion pathway apparatus. The desolvation apparatus defines a desolvation pathway along which a desolvation gas flows, in a direction from upstream to downstream. The ion pathway apparatus defines an ion pathway for analyte solution droplets to follow, the ion pathway leading into the mass spectrometer. The desolvation pathway has a desolvation pathway portion; and the ion pathway includes an ion pathway portion that follows the desolvation pathway portion.

The desolvation apparatus includes a structure, made up of one or more members, for directing the desolvation gas along the desolvation pathway. For instance, the desolvation apparatus may include first and second desolvation pathway members, disposed so as to define the desolvation pathway therebetween.

The structure includes a sample entrance and a sample exit, and a portion of the ion pathway runs between them. For instance, the sample entrance and the sample exit may be disposed at different points within the desolvation apparatus, such as within the first and second desolvation pathway members, respectively. The sample exit is downstream from the sample entrance.

Figure 2:
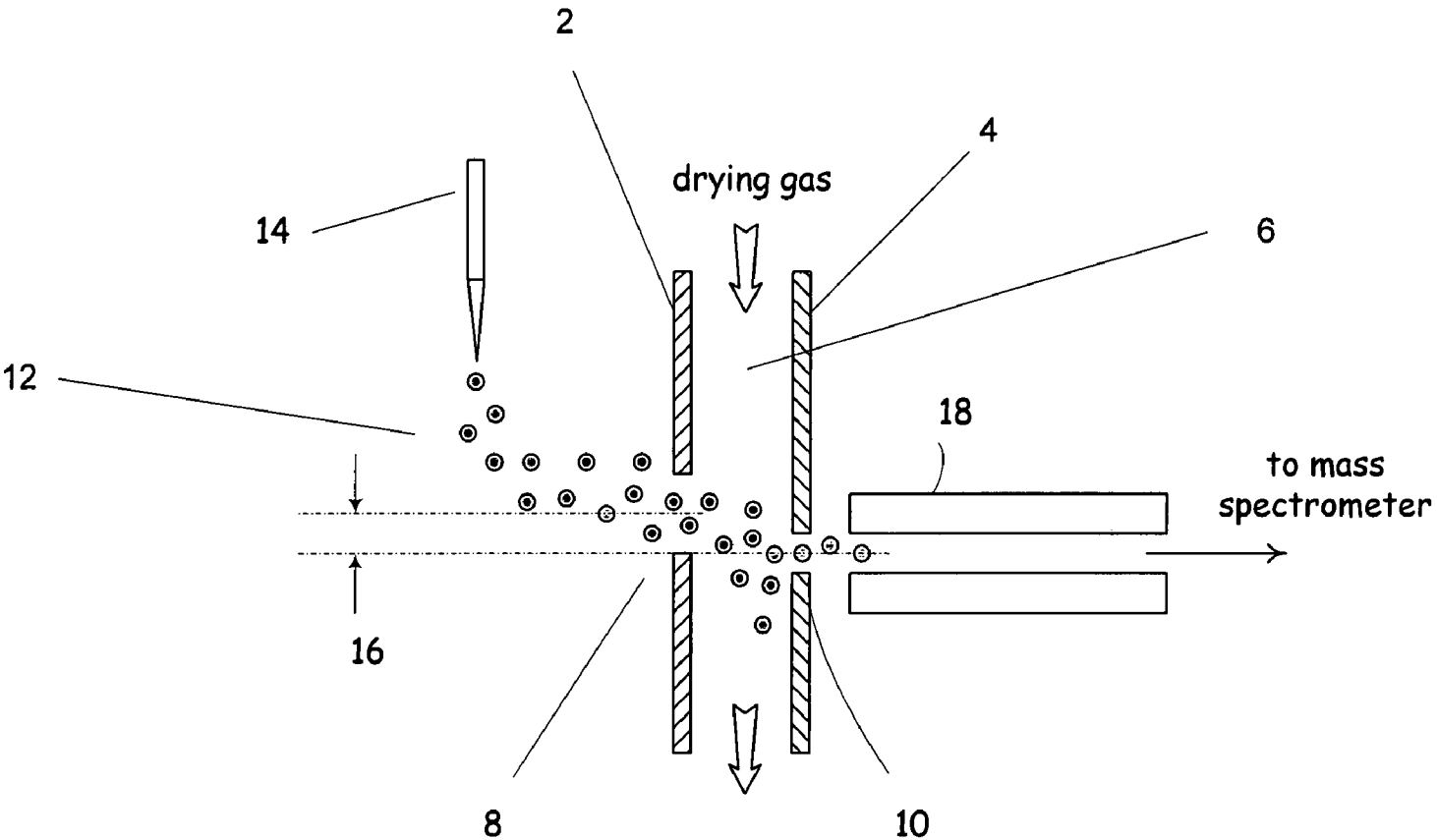
FIGS. 2, 3, and 4 are diagrams of mass spectrometer sample input interfaces embodying the invention.

FIG. 2 illustrates an exemplary embodiment of a mass spectrometer sample input interface. In this embodiment, the desolvation apparatus is shown as first and second plates 2 and 4, arranged substantially in parallel, at a predetermined distance from each other. The space in between the first plate 2 and the second plate 4 defines a desolvation pathway, shown as a channel 6 for desolvation gas. The desolvation pathway flows from upstream to downstream, as shown.

The embodiment additionally includes an ion pathway apparatus. In FIG. 2, the ion pathway apparatus is shown as a first orifice 8 in the first plate 2, and a second orifice 10 in the second plate 4. The second orifice 10 is displaced downstream of the first orifice 8 along the desolvation pathway.

The ion pathway apparatus defines an ion pathway, in which sample droplets 12 that are ionized by an ionizer apparatus, for instance including an ion source 14, travel through the first orifice 8 and the second orifice 10, along an ion pathway portion therebetween. The ion pathway portion leads from the first orifice 8, along the desolvation pathway portion, to the second orifice 10. Because the desolvation pathway portion runs from upstream to downstream, as does the desolvation pathway as a whole, likewise the ion pathway portion runs upstream to downstream.

The ion source 14 can be implemented according to various types of electrospray ionization. For instance it can include gas assisted spray, gas-free spray, micromachined spray tips, and/or spray tips made on a chip. For purposes of the present patent application, the terms "spray needle" and "spray tip" will be used interchangeably, and their meaning is in accordance with known terminology as outlined here.

Alternatively, other atmospheric pressure ionization sources such as atmospheric pressure chemical ionization (APCI), atmospheric pressure photo ionization (APPI), and atmospheric pressure matrix assisted laser desorption/ionization (AP-MALDI) may be used.

As shown in FIG. 2, the first and second orifices 8 and 10 are aligned such that they have an axial offset 16. If, for instance, the orifices 8 and 10 are circular in shape, the center of the second orifice 10 is shifted downstream, i.e., in the direction of the flow of the desolvation gas, relative to the center of the first orifice 8.

As the charged droplets 12 enter the first orifice 8, they continue to propagate towards the second plate 4. For instance, an electrical potential difference may be applied to the plates 2 and 4, generating an electrical field which attracts the charged droplets 12 and ions toward the second orifice 10. The potential difference may be user-adjustable for optimum performance.

However, because of the axial offset 16, the sample droplets 12 travel along an ion pathway portion, which coincides with and follows the desolvation pathway portion. Because of this ion pathway portion, the droplets 12 travel a greater distance, within the desolvation gas stream, than would be the case if the orifices 8 and 10 were directly aligned with each other and the ion pathway merely crossed perpendicular to the desolvation pathway.

By traveling this additional distance, the droplets 12 have a greater amount of time, and exposure to desolvation gas, to more completely undergo the desolvation process. More ions are generated, and fewer droplets remain, and enter the mass spectrometer for analysis. As a result, the mass spectrometer's analyte signal is enhanced.

It remains true, of course, that a portion of the droplets 12 are carried away by the gas flow, before they pass through the second orifice 10. However, sufficient ions remain for the mass spectrometer effectively to perform its analysis.

Since the two orifices 8 and 10 are offset, there is no direct line-of-sight in the path of the droplets 12. Because of this, incompletely desolvated droplets 12 are less likely to enter the second orifice 10. Thus, the mass spectrometer analysis is less affected by errors (sometimes characterized as "noise") caused by such droplets 12. As a result, the signal-to-noise ratio, and hence the mass spectrometer sensitivity, is increased.

The embodiment of FIG. 2 additionally includes known ion optical elements, generally shown as 18. The ion optical elements 18 are aligned with the second orifice 10, to direct ions from the second orifice 10 into the mass spectrometer (not shown) for analysis. The ion optical elements 18 may include an electrostatic lens, a radiofrequency multiple ion guide, etc.

In one embodiment of the invention, one or both of the plates 2 and 4 are adjustable in the direction of the drying gas flow, i.e., the axial offset of two orifices 8 and 10 is adjustable. The adjustment provides the possibility for optimizing the duration of desolvation time for different samples and flow rates. In another embodiment, he distance between the plates 2 and 4 is also variable so the signal-to-noise ratio can further be optimized.

In yet another embodiment, the orifices 8 and 10 may vary in size and shape, and the size and shape may be different, between the orifices 8 and 10. For instance, the first orifice 8 in the plate 2 on the atmospheric side may be larger than the second orifice 10 in the plate 4, facing the vacuum side.

In connection with the various embodiments just discussed, here are some dimensions for the various structures, which have been found to yield embodiments of the disclosed structure, that have worked well.

A gap between the first and second plates 2 and 4 can be 5 to 15 millimeters (mm), or more specifically about 10 mm. Where the first orifice 8 is circular in shape, its diameter can be 1 to 10 mm, or more specifically 3 to 6 mm. Likewise, where the second orifice 10 is circular, its diameter can be 1 to 5 mm, or more specifically 2 to 3 mm. Where the orifices 8 and 10 are both circular in shape, an offset distance between the orifices may conveniently be measured as an offset between their central axes. Such offset can be 1 to 10 mm, or more specifically 3 to 6 mm.

In another embodiment, the orifices 8 and 10 may be covered with porous voltage controllable members, such as conductive mesh grids. A selectable voltage, applied from a voltage source to one or both of such porous electrostatic members, will urge the ions through the orifices 8 and 10.

Figure 3:
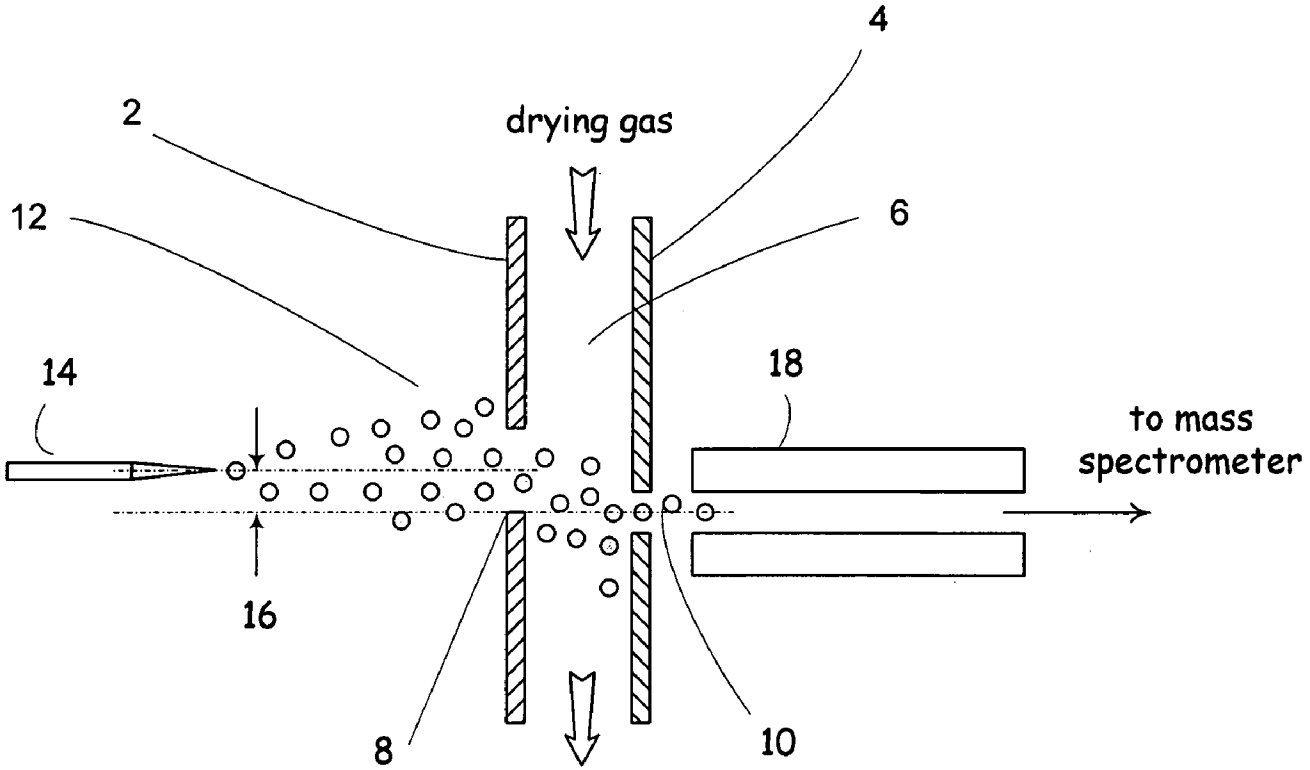
Figure 4:
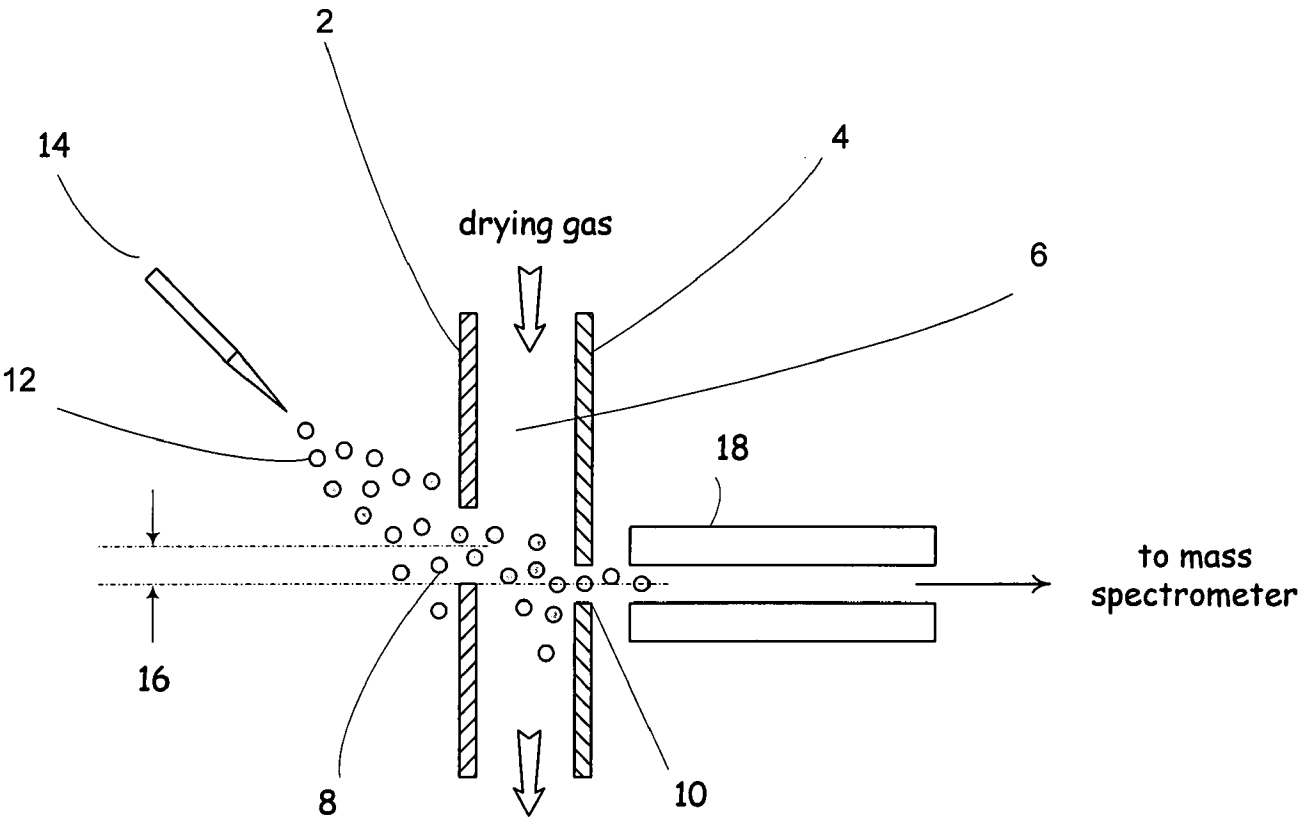

FIGS. 3 and 4 illustrate additional embodiments of the invention.

In a typical prior art embodiment in which the ion source 14 includes an elongated structure such as a spray needle, the spray needle is arranged parallel to the orifice plate, i.e., perpendicular to the orifice axis. This arrangement is widely used in a conventional spray interface to reduce noise by incompletely desolvated droplets entering the mass spectrometer. However, the need for such parallel configuration was a constraint brought about because of the line-of-sight alignment of the two orifices. This is because, in such conventional structures, the droplets 12 had an initial velocity which facilitated the passage of non-desolvated droplets 12 through the line-of-sight orifices into the mass spectrometer, with the resultant undesirable noise generation discussed above.

Embodiments of the invention can include an alignment apparatus (not shown) to align a position and/or an angular alignment of an ion source of an ionizer apparatus, relative to the ion pathway. The alignment apparatus may, in some embodiments, permit user adjustment of the ion source alignment.

In the embodiment of FIG. 2. the ion source 14 is shown as a spray tip that is aligned parallel to the plates 2 and 4. However, since, in interfaces embodying the present invention, there is no line-of-sight between the orifices 8 and 10 for the droplets 12, the spray arrangement is also more flexible.

In one alternative embodiment (FIG. 3), the spray tip of the ion source 14 is shown as being arranged perpendicular to the first plate 2, i.e., in line with the axis of the first orifice 8.

In another alternative embodiment (FIG. 4), the spray tip of the ion source 14 is shown as being arranged 45° to the axis of the first orifice 8.

Generally, the sensitivity of an atmospheric pressure ionization mass spectrometer is increased, when an interface structure embodying the invention is used. It has been found that mass spectrometers with sample input interfaces embodying the invention do not raise the manufacturing cost above that of mass spectrometers including prior art sample input interfaces. Moreover, since there is more flexibility for orienting spray tips relative to the interface, ionization of the sample droplets can be further optimized.

Although the present invention has been described in detail with reference to particular embodiments, persons possessing ordinary skill in the art to which this invention pertains will appreciate that various modifications and enhancements may be made without departing from the spirit and scope of the claims that follow.

What is claimed is:

1. A mass spectrometer sample input interface comprising:

a desolvation apparatus defining a desolvation pathway along which a desolvation gas flows, in a direction from upstream to downstream, the desolvation pathway having a desolvation pathway portion, the desolvation apparatus including a sample entrance and a sample exit, the sample exit being disposed downstream, relative to the sample entrance; and an ion pathway apparatus for defining an ion pathway for analyte solution droplets to follow, the ion pathway leading into the mass spectrometer, the ion pathway including an ion pathway portion that follows the desolvation pathway portion and that runs from the sample entrance to the sample exit; wherein:

the desolvation apparatus includes first and second desolvation pathway members, disposed so as to define the desolvation pathway therebetween;

the ion pathway apparatus includes a first orifice within the first desolvation pathway member, the first orifice serving as the sample entrance, the ion pathway apparatus further includes a second orifice within the second desolvation pathway member, the second orifice serving as the sample exit;

the second orifice is downstream of the first orifice along the desolvation pathway at an axial offset relative to the first orifice, such that the ion pathway portion leads from the first orifice, along the desolvation pathway portion, to the second orifice; and wherein the ion pathway apparatus further includes an orifice adjustment apparatus for adjusting the positions of the first and second orifices relative to each other so as to (i) change the axial offset of the second orifice relative to the first orifice, and (ii) change a distance between the first and second desolvation pathway members.

2. A mass spectrometer sample input interface as recited in claim 1, further comprising:

a porous voltage controllable member disposed to cover one of the first orifice and the second orifice; and a voltage source, coupled to apply a selectable voltage to the porous voltage controllable member.

3. A mass spectrometer sample input interface as recited in claim 2, wherein the porous voltage controllable member includes a conductive mesh grid.

4. A mass spectrometer sample input interface as recited in claim 1, further comprising:

an ionizer apparatus including an ion source; and an alignment apparatus for adjusting one of (i) a position, and (ii) an angular alignment, of the ion source, relative to the ion pathway.

5. A mass spectrometer sample input interface as recited in claim 1, wherein the first orifice is larger than the second orifice.

6. A mass spectrometer system comprising:

a mass spectrometer sample input interface which includes:

a desolvation apparatus defining a desolvation pathway along which a desolvation gas flows, in a direction from upstream to downstream, the desolvation pathway having a desolvation pathway portion, the desolvation apparatus including a sample entrance and a sample exit, the sample exit being disposed downstream, relative to the sample entrance; and an ion pathway apparatus for defining an ion pathway for analyte solution droplets to follow, the ion pathway leading into the mass spectrometer, the ion pathway including an ion pathway portion that follows the desolvation pathway portion and that runs from the sample entrance to the sample exit; wherein:

the desolvation apparatus includes first and second desolvation pathway members, disposed so as to define the desolvation pathway therebetween;

the ion pathway apparatus includes a first orifice within the first desolvation pathway member the first orifice serving as the sample entrance, the ion pathway apparatus further includes a second orifice within the second desolvation pathway member, the second orifice serving as the sample exit;

the second orifice is downstream of the first orifice along the desolvation pathway at an axial offset relative to the first orifice, such that the ion pathway portion leads from the first orifice, along the desolvation pathway portion, to the second orifice; and wherein the ion pathway apparatus further includes an orifice adjustment apparatus for adjusting the positions of the first and second orifices relative to each other so as to (i) change the axial offset of the second orifice relative to the first orifice, and (ii) change a distance between the first and second desolvation pathway members.

7. A mass spectrometer system as recited in claim 6, wherein the mass spectrometer sample input interface further includes:

a porous voltage controllable member disposed to cover one of the first orifice and the second orifice; and a voltage source, coupled to apply a selectable voltage to the porous voltage controllable member.

8. A mass spectrometer system as recited in claim 7, wherein the porous voltage controllable member includes a conductive mesh grid.

9. A mass spectrometer system as recited in claim 6, wherein the mass spectrometer sample input interface further includes:

an ionizer apparatus including an ion source; and an alignment apparatus for adjusting one of (i) a position, and (ii) an angular alignment, of the ion source, relative to the ion pathway.

10. A mass spectrometer system as recited in claim 6, wherein the first orifice is larger than the second orifice.

11. A method for preparing a sample solution for analysis by a mass spectrometer, the method comprising:

providing a flow of desolvation gas along a desolvation pathway having a desolvation pathway portion, generating ionized droplets of the solution for desolvation, by the desolvation gas, into gaseous ions; and directing the ionized droplets along an ion pathway into the mass spectrometer for analysis, the ion pathway having an ion pathway portion which runs along the desolvation pathway portion, the ion pathway portion running between first and second orifices of a sample input interface of the mass spectrometer, the sample input interface including:

a desolvation apparatus defining a desolvation pathway along which a desolvation gas flows, in a direction from upstream to downstream, the desolvation pathway having a desolvation pathway portion, the desolvation apparatus including a sample entrance and a sample exit, the sample exit being disposed downstream, relative to the sample entrance; and an ion pathway apparatus for defining an ion pathway for analyte solution droplets to follow, the ion pathway leading into the mass spectrometer, the ion pathway including an ion pathway portion that follows the desolvation pathway portion, and that runs from the sample entrance to the sample exit; wherein:

the desolvation apparatus including first and second desolvation pathway members, disposed so as to define the desolvation pathway therebetween;

the ion pathway apparatus including a first orifice within the first desolvation pathway member the first orifice serving as the sample entrance, the ion pathway apparatus further including a second orifice within the second desolvation pathway member, the second orifice serving as the sample exit;

the second orifice being downstream of the first orifice along the desolvation pathway at an axial offset relative to the first orifice, such that the ion pathway portion leads from the first orifice, along the desolvation pathway portion, to the second orifice; and wherein the method further comprises adjusting a relative position between the first and second orifices so as to (i) change the axial offset of the second orifice relative to the first orifice, and (ii) change a distance between the first and second desolvation pathway members.

12. A method as recited in claim 11, further comprising drawing the ionized droplets along the ion pathway portion by electrical attraction of a porous voltage controllable member disposed to cover one of the first and second orifices.

13. A method as recited in claim 12, further comprising applying a selectable voltage to the porous voltage controllable member.

14. A method as recited in claim 11, wherein generating includes adjusting, relative to the ion pathway, one of (i) a position, and (ii) an angular alignment, of an ion source.

* * * * *